US010429797B2

(12) United States Patent
Miwa

(10) Patent No.: US 10,429,797 B2
(45) Date of Patent: Oct. 1, 2019

(54) MODULE AND TIMEPIECE

(71) Applicant: CASIO COMPUTER CO., LTD., Tokyo (JP)

(72) Inventor: Jun Miwa, Higashiyamato (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/637,549

(22) Filed: Jun. 29, 2017

(65) Prior Publication Data

US 2018/0039228 A1 Feb. 8, 2018

(30) Foreign Application Priority Data

Aug. 5, 2016 (JP) ..... 2016/154664

(51) Int. Cl.

*G04B 19/04* (2006.01)
*G04C 17/00* (2006.01)
*G04F 8/00* (2006.01)

(52) U.S. Cl.

CPC ..... *G04B 19/04* (2013.01); *G04B 19/042* (2013.01); *G04B 19/044* (2013.01); *G04C 17/0091* (2013.01); *G04F 8/006* (2013.01)

(58) Field of Classification Search

CPC .... G04B 19/04; G04B 19/042; G04B 19/044; G04C 17/0091; G04F 8/006

See application file for complete search history.

(56) References Cited

U.S. PATENT DOCUMENTS 4,241,339 A * 12/1980 Ushiyama ..... G02F 1/13475 345/22
4,453,833 A * 6/1984 Saitoh ..... G04C 10/00 368/204
6,147,934 A * 11/2000 Arikawa ..... G02B 27/283 349/96
6,594,202 B1 * 7/2003 Ting ..... G04G 21/00 368/10
6,982,931 B2 * 1/2006 Brewer ..... G02F 1/133536 349/113
8,717,855 B2 * 5/2014 Sato ..... G04B 19/087 368/223
10,228,657 B2 3/2019 Lagorgette et al.
2004/0174774 A1 9/2004 Tasaka et al.

(Continued)

FOREIGN PATENT DOCUMENTS

CN 105829978 A 8/2016
JP S54-177972 U 12/1979

(Continued)

OTHER PUBLICATIONS

Notification of Reasons for Refusal dated May 7, 2018 received in Japanese Patent Application No. JP 2016-154664 together with an English language translation.

(Continued)

*Primary Examiner* — Sean P Kayes
(74) *Attorney, Agent, or Firm* — Scully Scott Murphy & Presser

(57) ABSTRACT

A module including a hand driving mechanism section which drives a hand shaft to which hands are attached so as to move the hands, and a display section which is arranged in parallel with the hand driving mechanism section and displays information.

13 Claims, 4 Drawing Sheets

(56) References Cited

U.S. PATENT DOCUMENTS

| | | | | |
|---|---|---|---|---|
| 2004/0179464 | A1* | 9/2004 | Maruyama | G04G 9/0064 369/292 |
| 2007/0014193 | A1* | 1/2007 | Plancon | G04B 19/082 368/80 |
| 2010/0046328 | A1* | 2/2010 | Olsen | G04B 19/04 368/30 |
| 2016/0320745 | A1 | 11/2016 | Lagorgette et al. | |

FOREIGN PATENT DOCUMENTS

| | | | |
|---|---|---|---|
| JP | S56-002579 | A | 1/1981 |
| JP | S62-133185 | U | 8/1987 |
| JP | H08-129078 | A | 5/1996 |
| JP | 2004-271259 | A | 9/2004 |
| JP | 2015-114121 | A | 6/2015 |

OTHER PUBLICATIONS

First Office Action dated Jun. 6, 2019 received in Japanese Patent Application No. CN 201710632369.8 together with an English language translation.

* cited by examiner

MODULE AND TIMEPIECE

CROSS-REFERENCE TO RELATED APPLICATION

This application is based upon and claims the benefit of priority from the prior Japanese Patent Application No. 2016-154664, filed Aug. 5, 2016, the entire contents of which are incorporated herein by reference.

BACKGROUND OF THE INVENTION

1. Field of the Invention

The present invention relates to a module that is used for electronic devices such as wristwatches, mobile phones, and portable digital assistants, and a timepiece having the same.

2. Description of the Related Art

For example, a timepiece module for a wristwatch is known which has a structure including a display device that planarly displays information and a hand driving mechanism section which moves hands above this display device, as described in Japanese Patent Application Laid-Open (Kokai) Publication No. 08-129078.

In this timepiece module for a wristwatch, the hand driving mechanism section is arranged below the display device. Accordingly, the length of the hand shaft of the hand driving mechanism section to which the hands are attached must be made large. Thus, in a combination timepiece having display functions of an analog timepiece and a digital timepiece, the hand shaft is long. In this case where the diameter of the hand shaft is restricted, the rigidity of the hand shaft cannot be sufficiently ensured.

SUMMARY OF THE INVENTION

An object of the present invention is to provide a module where multifunctional display can be performed and the length of a hand shaft for hands that indicate the time can be shortened, and a timepiece having the same.

In accordance with one aspect of the present invention, there is provided a module comprising: a hand driving mechanism section which drives a hand shaft to which hands are attached so as to move the hands; and a display section which is arranged in parallel with the hand driving mechanism section and displays information.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

An embodiment where the present invention has been applied in a wristwatch will hereinafter be described with reference to FIG. 1 to FIG. 4.

Figure 1:
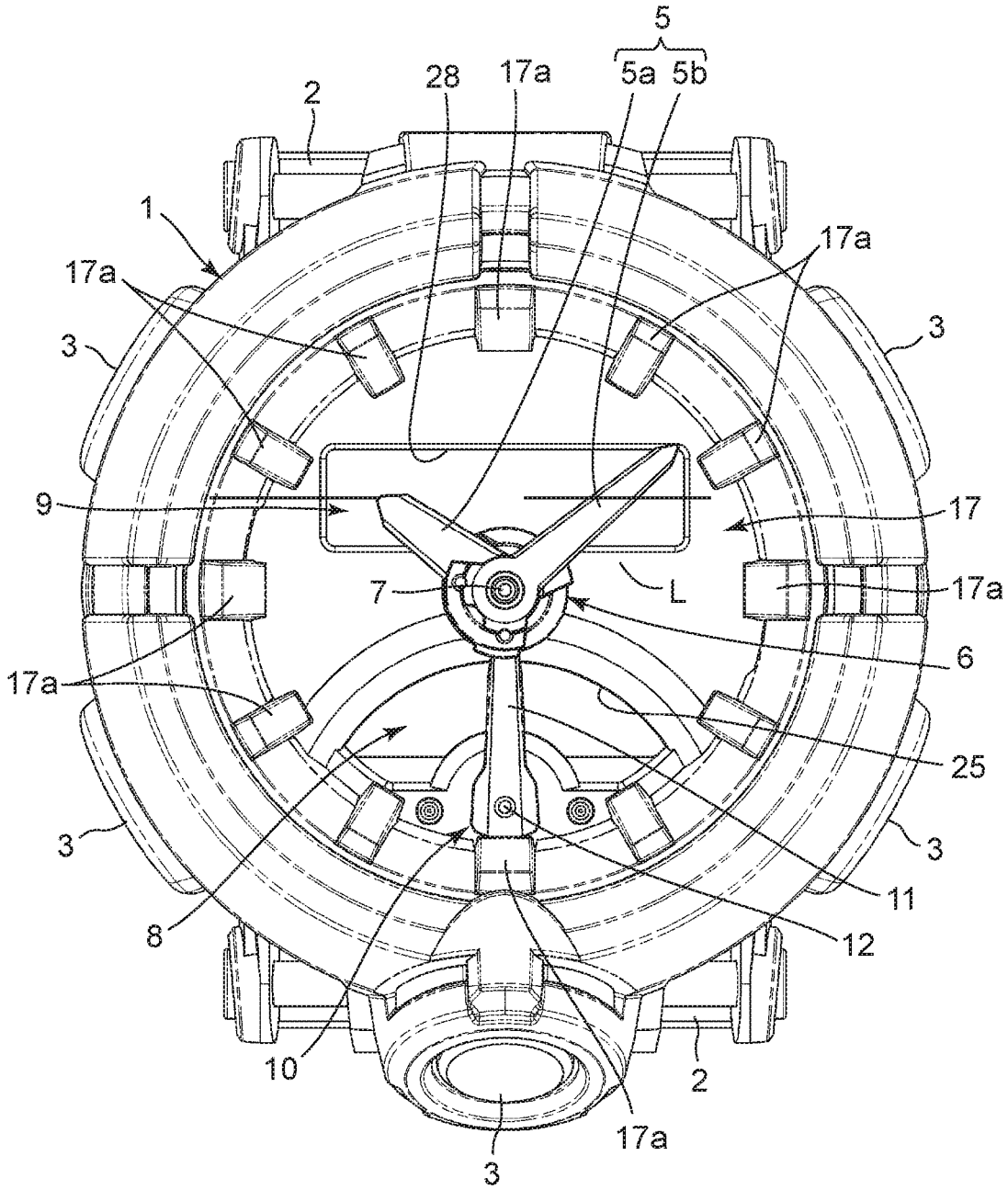
FIG. 1 is an enlarged front view showing an embodiment where the present invention has been applied in a wristwatch.

This wristwatch includes a wristwatch case 1, as shown in FIG. 1. On the 12 o'clock side and the 6 o'clock side of this wristwatch case 1, band attachment sections 2 to which a timepiece band (not shown) is attached are respectively provided. On the 2 o'clock side, the 4 o'clock side, the 6 o'clock side, the 8 o'clock side, and the 10 o'clock side of this wristwatch case 1, switch sections 3 are respectively provided.

Figure 2:
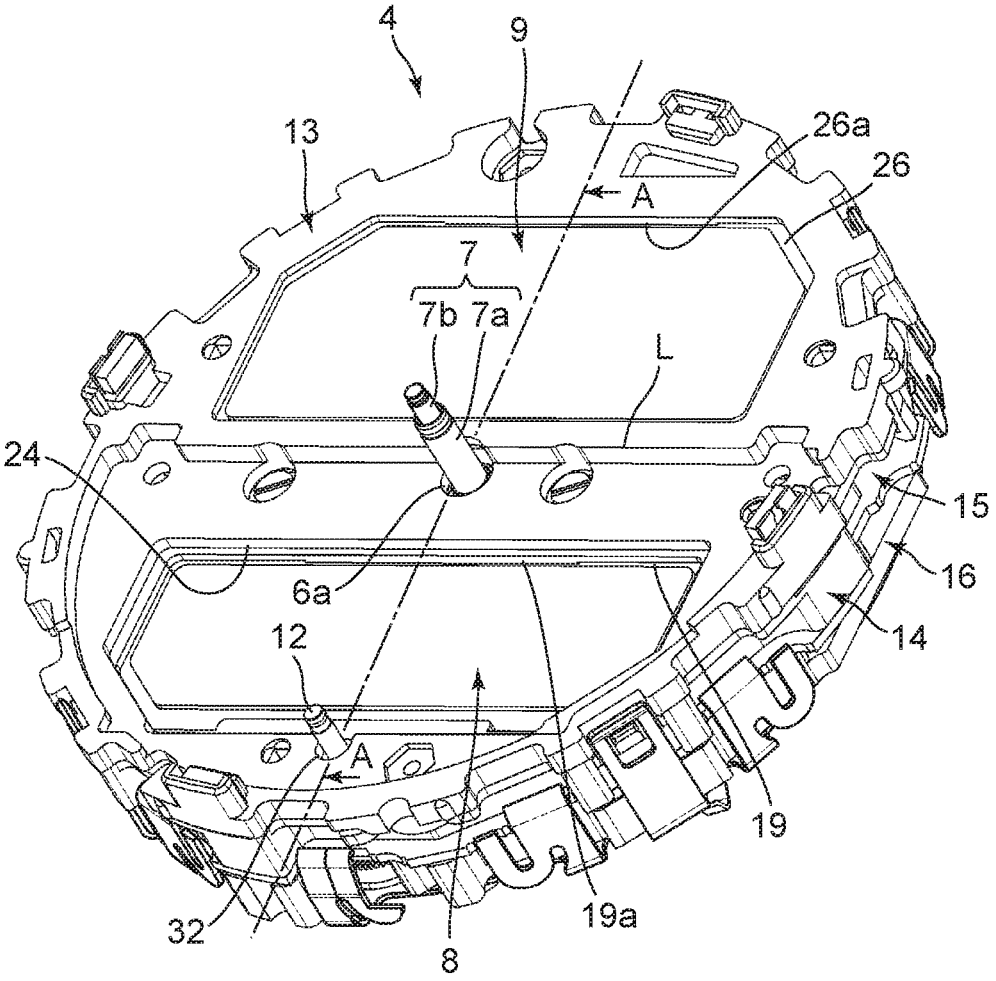
FIG. 2 is an enlarged perspective view showing a timepiece module incorporated into the wristwatch shown in FIG. 1.
Figure 3:
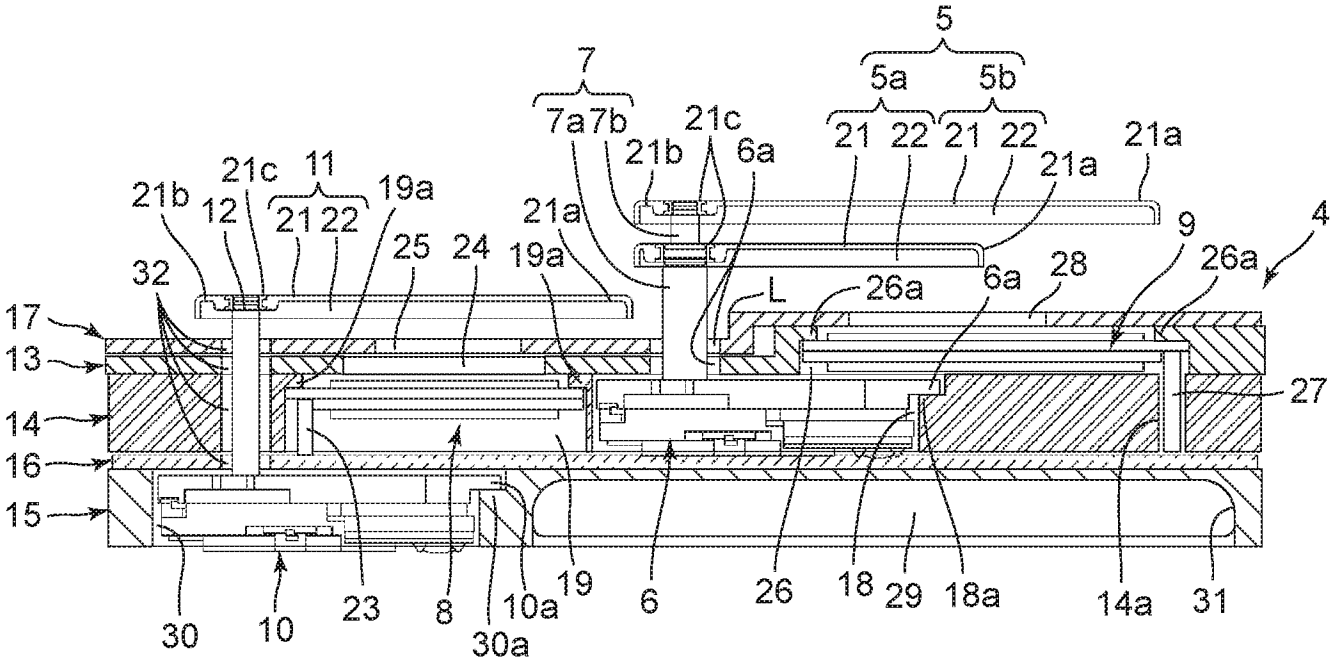
FIG. 3 is an enlarged sectional view of the main section of the timepiece module taken along line A-A in FIG. 2.

In the wristwatch case 1, a timepiece module 4 is provided, as shown in FIG. 2 to FIG. 3. This timepiece module 4 includes a hand driving mechanism section 6 that drives a hand shaft 7 where hands 5 are attached so as to move the hands 5, and a first display device 8 arranged in parallel with this hand driving mechanism section 6.

Also, this timepiece module 4 includes a second display device 9 arranged at a position one step higher than the first display device 8 and a function hand driving mechanism section 10 which is arranged below the first display device 8 and moves a function hand 11 attached to a function hand shaft 12 in an area above the first display device 8, as shown in FIG. 2 and FIG. 3.

In this embodiment, the timepiece module 4 includes an upper housing 13, an intermediate housing 14, and a lower housing 15, and is structured such that a circuit board 16 is arranged between the intermediate housing 14 and the lower housing 15 and a dial 17 is arranged on the upper surface of the upper housing 13, as shown in FIG. 2 to FIG. 3.

The upper housing 13 is formed such that the thickness of a portion from its substantially central portion to the 12 o'clock side is large and the thickness of a portion from the substantially central portion to the 6 o'clock side is small, as shown in FIG. 2 and FIG. 3. Thus, the upper housing 13 is formed such that the 12 o'clock side is one step higher and the 6 o'clock side is one step lower with a step section L, which is on a straight line connecting the 3 o'clock side and the 9 o'clock side at a point slightly closer to the 12 o'clock side than the central portion, as a boundary.

Accordingly, the dial 17 on the upper housing 13 is formed such that the 12 o'clock side is one step higher and the 6 o'clock side is one step lower with the step section L on the straight line connecting the 3 o'clock side and the 9 o'clock side as a boundary, as shown in FIG. 2 and FIG. 3. On outer peripheral portions of the upper surface of this dial 17, hour marks 17*a* are formed such that they are evenly spaced apart from one another, as shown in FIG. 1.

Also, in the intermediate housing 14, the hand driving mechanism section 6 and the first display device 8 are arranged in parallel with each other in a planar view, as shown in FIG. 2 and FIG. 3. That is, the hand driving mechanism section 6 is arranged in a first mechanism housing section 18 provided from the central portion of the intermediate housing 14 toward the 12 o'clock side. The first display device 8 is formed having a rectangular shape which is long in the transverse direction (the direction connecting the 3 o'clock side and the 9 o'clock side), and arranged in a first display housing section 19 provided between the central portion of the intermediate housing 14 and the 6 o'clock side.

The hand driving mechanism section 6 is structured such that, when the hand driving mechanism section 6 is housed from above in the first mechanism housing section 18 provided in the intermediate housing 14, a first projection section 6*a* provided on an upper portion of the outer peripheral surface of the hand driving mechanism section 6 comes in contact with a first contact section 18*a* on an upper portion of the inner peripheral surface of the first mechanism housing section 18 from above, whereby the hand driving mechanism section 6 is arranged in the first mechanism housing section 18 in the intermediate housing 14, as shown in FIG. 2 and FIG. 3.

This hand driving mechanism section 6 is structured such that, as shown in FIG. 2 and FIG. 3, the hand shaft 7 protrudes upward from the dial 17 via a through hole 6*a* provided from a central portion of the intermediate housing 14 to central portions of the upper housing 13 and the dial 17, the hands 5 are attached to the upper end of the protruding hand shaft 7, and these hands 5 move above the dial 17 in this state so as to indicate hour marks 17*a* for time display, as shown in FIG. 1.

In this embodiment, the hand shaft 7 is structured to be positioned at the above-described portions of the upper housing 13 and the dial 17 formed to be one step lower, and protrudes above the upper surface of the above-described portion of the dial 17 formed to be one step higher, as shown in FIG. 2 and FIG. 3. That is, the hand shaft 7 includes a cylindrical hour hand shaft 7*a* of an hour hand wheel serving as a cylindrical wheel, and a minute hand shaft 7*b* of a minute hand wheel serving as a second wheel which is rotatably arranged within the hour hand shaft 7*a* and whose upper end protrudes above the hour hand shaft 7*a*.

The hand shaft 7 is formed to have, although its axial length is limited, the maximum axial length within the limitations of its production, as shown in FIG. 2 and FIG. 3. As a result, this hand shaft 7 is structured to protrude by a sufficient length above the upper surface of the first display device 8 which is arranged in parallel with the hand driving mechanism section 6 in a planar view, or in other words, upwardly protrudes by a sufficient length from the upper surface of the portion of the dial 17 formed to be one step lower, and sufficiently protrudes above the upper surface of the portion of the dial 17 formed to be one step higher.

Also, the hands 5 include an hour hand 5*a* and a minute hand 5*b*, and are attached to an upper portion of the hand shaft 7 protruding by a sufficient length above the portion of the dial 17 formed to be one step lower, as shown in FIG. 1 to FIG. 3. That is, the minute hand 5*b* is formed to be longer than the hour hand 5*a*, and is attached to the upper end of the minute hand shaft 7*b* of the hand shaft 7 protruding most above the upper surface of the portion of the dial 17 formed to be one step higher.

The hour hand 5*a* is formed to be shorter than the minute hand 5*b*, attached to the upper end of the hour hand shaft 7*a* of the hand shaft 7 positioned above the upper surface of the portion of the dial 17 formed to be one step higher, and arranged below the minute hand 5*b*, as shown in FIG. 1 to FIG. 3. These hands 5 are structured to move above the entire area of the dial 17, namely, both the portion of the dial 17 formed to be one step higher and the portion of the dial 17 formed to be one step lower.

Figure 4:
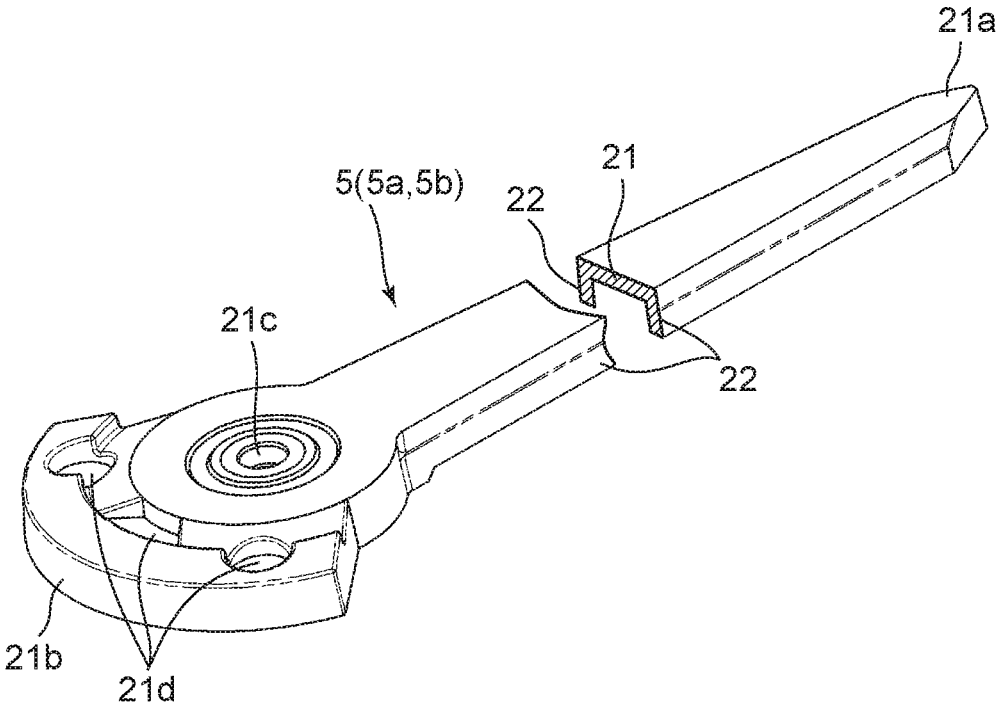
FIG. 4 is an enlarged perspective view of a hand shown in FIG. 3, which is partly in section.

In this embodiment, the hands 5, which are the hour hand 5*a* and the minute hand 5*b*, are formed of synthetic resin or metal and have a thick shape, as shown in FIG. 1, FIG. 3, and FIG. 4. Each hand 5 includes a hand body 21 having a substantially band shape and a sidewall section 22 provided on an outer peripheral portion of the hand body 21. In this embodiment, the hand body 21 is formed having the same shape as that of a normal hand or a slightly wider shape.

That is, this hand body 21 is structured such that its one end 21*a* is formed to be tapered, the other end 21*b* is formed in a substantially fan shape, a shaft attachment hole 21*c* to which the hand shaft 7 is attached is provided in a pivot portion of the substantially fan shape of the other end 21*b*, and a decorative section 21*d* is provided at the other end 21*b* in a substantially fan shape, as shown in FIG. 3 and FIG. 4.

Also, the sidewall section 22 is formed on the outer peripheral portion of the hand body 21 while hanging downward over the entire periphery of the hand body 21, as shown in FIG. 3 and FIG. 4. As a result, the sidewall section 22 is structured to thicken the entire hand 5. Accordingly, each hand 5 is structured such that the outer surface of the sidewall section 22, together with the hand body 21, is decorated with a color, a mark, etc. (not shown).

The first display device 8 displays an elapsed time such as a second time or a minute time using a chronograph, and includes a flat display panel such as a liquid crystal display panel or an electroluminescence (EL) display panel, as shown in FIG. 2 and FIG. 3. This first display device 8 is structured to be arranged in the first display housing section 19 in the intermediate housing 14 while being electrically connected to the circuit board 16 by an inter connector 23.

That is, the first display device 8 is structured such that, when it is housed from below in the first display housing section 19 in the intermediate housing 14, the upper surface of an outer peripheral portion of the first display device 8 abuts from below on a first flange section 19*a* provided on an upper portion of the inner peripheral surface of the first display housing section 19, and the lower surface of the outer peripheral portion is supported by the inter connector 23, as shown in FIG. 3.

In this embodiment, the inter connector 23 is structured such that its lower end comes in contact with a connection terminal (not shown) provided on the upper surface of the circuit board 16 and its upper end comes in contact with a connection terminal (not shown) provided on the lower surface of the outer peripheral portion of the first display device 8, whereby the circuit board 16 and the first display device 8 are electrically connected to each other, as shown in FIG. 3

Also, the first display device 8 is structured such that its display area has a circular arc shape and information regarding an elapsed time such as a second time or a minute time is electrooptically displayed using a chronograph within the display area having a circular arc shape, as shown in FIG. 1 and FIG. 3. Accordingly, in the portion of the upper housing 13 formed to be one step lower, a first housing display window section 24 is provided corresponding to the first display device 8, as shown in FIG. 2 and FIG. 3. This first housing display window section 24 is formed having a rectangular shape of substantially the same size as that of the first display device 8.

Also, in the portion of the dial 17 formed to be one step lower, a first dial display window section 25 is provided corresponding to the display area of the first display device 8, as shown in FIG. 1 and FIG. 3. That is, this first dial display window section 25 is formed having a circular arc shape corresponding to the display area of the first display device 8. As a result, the first display device 8 is structured such that information displayed thereon can be viewed from above with it being in a concave area with depth created by the first housing display window section 24 in the upper housing 13 and the first dial display window section 25 in the dial 17.

On the other hand, in the portion of the upper housing 13 formed to be one step higher, the second display device 9 is arranged to be one step higher than the first display device 8 with it not overlapping with the first display device 8, as shown in FIG. 2 and FIG. 3. This second display device 9 displays information regarding time, date, and day by using characters and numbers.

As shown in FIG. 2 and FIG. 3, the second display device 9 has a substantially rectangular shape which is long in the transverse direction (the direction connecting the 3 o'clock and the 9 o'clock side). This second display device 9 is arranged within a second display housing section 26. Except for the outer periphery of the portion of the upper housing 13 formed one step higher, the second display housing section 26 is provided over substantially the entire area of the portion of the upper housing 13 formed one step higher, on the 12 o'clock side of the step section L positioned on the straight line connecting the 3 o'clock side and the 9 o'clock side.

That is, this second display device 9 includes a flat display panel such as a liquid crystal display panel or an EL display panel as with the first display device 8, and is structured to be arranged within the second display housing section 26 in the upper housing 13 while being electrically connected to the circuit board 16 by an inter connector 27, as shown in FIG. 2 and FIG. 3.

In this embodiment, the second display device 9 is structured such that, when it is housed from below within the second display housing section 26 in the upper housing 13, the upper surface of an outer peripheral portion of the second display device 9 abuts from below on a second flange section 26*a* provided on an upper portion of the inner peripheral surface of the second display housing section 26 and the lower surface of the outer peripheral portion is supported by the inter connector 27, as shown in FIG. 2 and FIG. 3.

In this embodiment, the inter connector 27 is structured such that it is arranged within a connector hole 14*a* provided penetrating in the vertical direction via the intermediate housing 14, its lower end comes in contact with a connection terminal (not shown) provided on the upper surface of the circuit board 16, and its upper end comes in contact with a connection terminal (not shown) provided on the lower surface of the outer peripheral portion of the second display device 9, whereby the circuit board 16 and the second display device 9 are electrically connected to each other, as shown in FIG. 3.

As a result, the second display device 9 is structured to be arranged within the second display housing section 26 in the upper housing 13 with the lower surface thereof being positioned near the top of the hand driving mechanism section 6 and the upper surface thereof being positioned below and away from the hands 5, as shown in FIG. 2 and FIG. 3. In this embodiment, the second display device 9 is structured such that its display area has a rectangular shape smaller than the shape of the second display device 9, and information regarding time, date, and day is electrooptically displayed within this small display area in a rectangular shape, as shown in FIG. 1, FIG. 2 and FIG. 3.

Accordingly, in the portion of the dial 17 formed one step higher, a second dial display window section 28 is provided corresponding to the second display housing section 26 in the upper housing 13, as shown in FIG. 1 and FIG. 3. This second dial display window section 28 is formed having a shape corresponding to the display area of the second display device 9, namely, a rectangular shape smaller than the shape of the second display device 9.

As a result, the second display device 9 is structured such that displayed information regarding time, date, and day can be viewed from above via the second dial display window 28 in the dial 17, as shown in FIG. 3. In this embodiment, the dial 17 is arranged with its upper surface being positioned below and away from the hour hand 5*a* positioned below the minute hand 5*b* of the hands 5.

In the lower housing 15, the function hand driving mechanism section 10 and a button-type battery 29 are arranged in parallel with each other in a planar view, as shown in FIG. 2 and FIG. 3. In this embodiment, the function hand driving mechanism section 10 is arranged within a second mechanism housing section 30 provided on the 6 o'clock side in the lower housing 15. The button-type battery 29 is arranged within the battery housing section 31 provided in a wide area of the lower housing 15 located from the 6 o'clock side of the central portion to the 12 o'clock side excluding the area of the second mechanism housing section 30.

That is, the function hand driving mechanism section 10 is structured such that, when housed from above within the second mechanism housing section 30 provided in the lower housing 15, it is arranged within the second mechanism housing section 30 in the lower housing 15 by a second projection section 10*a* provided on an upper portion of the outer peripheral surface of the function hand driving mechanism section 10 coming in contact with a second contact section 30*a* provided on an upper portion of the inner peripheral surface of the second mechanism housing section 30 from above, as shown in FIG. 3.

This function hand driving mechanism section 10, which is used to selectively indicate various types of modes such as a timer mode, a stopwatch mode, and an azimuth mode (retrograde mode) using the function hand 11, is structured such that the functional hand 11 is moved above the first display device 8 so as to select and indicate a mode, as shown in FIG. 1 to FIG. 3.

That is, this function hand driving mechanism section 10 is structured such that the function hand shaft 12 is positioned on the 6 o'clock side of the lower housing 15 and protrudes above the portion of the dial 17 formed one step lower via a through hole 32 provided penetrating through the circuit board 16, the intermediate housing 14, the upper housing 13, and the dial 17; the function hand 11 is attached to the upper end of the protruding function hand shaft 12; and the function hand 11 moves above the portion of the dial 17 formed one step lower, as shown in FIG. 2 and FIG. 3.

In this embodiment, the function hand shaft 12 is structured to protrude above the first display device 8 via a side portion of the first display device 8 on the 6 o'clock side, as shown in FIG. 2 and FIG. 3. That is, this function hand shaft 12 is formed to have, although its axial length is limited, the maximum axial length within the limitations of its production. As a result, the function hand shaft 12 is structured to upwardly protrude by a sufficient length from the upper surface of the portion of the dial 17 formed one step lower.

Also, the function hand 11 is formed of synthetic resin or metal and has a thick shape as with the hands 5, as shown in FIG. 3 and FIG. 4. That is, this function hand 11 includes a hand body 21 having a substantially band plate shape and a sidewall section 22 provided on an outer peripheral portion of this hand body 21. The hand body 21 is formed having the same shape as that of a normal hand or a slightly wider shape, as in the case of the hands 5.

In this embodiment, the hand body 21 is structured such that its one end 21*a* is formed to be tapered, the other end 21*b* is formed to be wide, the shaft attachment hole 21*c* is provided in a wide central portion of the other end 21*b*, and the wide other end 21*b* has a shape that can be decorated as in the case of the hands 5, as shown in FIG. 1 and FIG. 3.

Also, the sidewall section 22 is formed on the outer peripheral portion of the hand body 21 while hanging downward over the entire periphery as in the case of the hands 5, as shown in FIG. 3. As a result, the sidewall section 22 is structured to thicken the entire function hand 11. Accordingly, this function hand 11 is structured such that the outer surface of the sidewall section 22, together with the hand body 21, is decorated with a color, a mark, etc. (not shown).

In this embodiment, the function hand 11 is structured such that its lower end in the thickness direction is positioned below the upper surface of the portion of the dial 17 formed one step higher, its upper surface is positioned above the portion of the dial 17 formed one step higher, and the function hand 11 moves above the portion of the dial 17 formed one step lower, as shown in FIG. 2 and FIG. 3. That is, this function hand 11 is structured to move with it being positioned substantially in parallel with the second display device 9 arranged one step higher than the first display device 8.

As a result, as shown in FIG. 2 and FIG. 3, the function hand 11 is structured to be positioned further below the hour hand 5*a* positioned below the minute hand 5*b* of the hands 5, and to move to swing above the dial 17 around the function hand shaft 12 above the portion of the dial 17 formed one step lower with it being positioned substantially in parallel with the second display device 9, without coming in contact with the hour hand 5*a*.

The button-type battery 29 is structured to be arranged from below within the battery housing section 31 provided in the wide area of the lower housing 15 located from the 6 o'clock side of the central portion to the 12 o'clock side, as shown in FIG. 3. Accordingly, by the mounting space being set wide, this battery 29 is formed having a large outer shape, a larger size, and a larger capacity.

Next, the mechanism of the timepiece module 4 in the wristwatch is described.

In the timepiece module 4 in a normal state, the hand shaft 7 of the hand driving mechanism section 6 is driven by the hand driving mechanism section 6, and the hands 5 attached to the hand shaft 7 indicate hour marks 17*a* on the dial 17 while moving 360 degrees above the dial 17 so as to indicate the time.

Here, the hand shaft 7 of the hand driving mechanism section 6 protrudes by a sufficient length above the first display device 8 although its length is a limited length, and sufficiently protrudes above the second display device 9 positioned one step higher than the first display device 8. As a result of this structure, the hands 5 can be formed having a free shape without being restricted by the thickness.

Accordingly, the hands 5 herein are formed having a thick shape with synthetic resin or metal, and thereby can be easily viewed. As a result, the time indicated thereby can be easily viewed. That is, each hand 5 is structured to include the hand body 21 having a substantially band shape and the sidewall section 22 provided on the outer peripheral portion of the hand body 21. By being thickened therewith, the hands 5 are formed larger, and thereby can be easily viewed. That is, hands having a strong presence can be actualized.

In this embodiment, in each hand 5, the decorative section 21*d* is provided in the other end 21*b* of the hand body 21 having a substantially fan shape, and the outer surface of the sidewall section 22, together with the hand body 21, is decorated with a color, a mark, etc. (not shown). As a result, its decoration and design can be improved, whereby hands having a greater presence are actualized.

In addition, on the first display device 8, information regarding an elapsed time such as a second time or a minute time is displayed using a chronograph. This displayed information can be viewed from above via the first housing display window section 24 having a rectangular shape and provided in the upper housing 13 and the first dial display window section 25 having a circular arc shape and provided in the dial 17. That is, information regarding an elapsed time such as a second time or a minute time displayed on the first display device 8 can be viewed using a chronograph.

In this embodiment, the information regarding an elapsed time such as a second time or a minute time displayed on the first display device 8 can be viewed with it being in the concave area with depth created by the first housing display window section 24 and the first dial display window section 25. By this sense of depth, the information displayed on the first display device 8 is stereoscopically displayed, which enhances the design.

Also, on the second display device 9, information regarding time, date, and day is displayed by using characters and numbers. This displayed information can be viewed from above via the second dial display window section 28 provided in a rectangular shape smaller than the shape of the second display device 9 in the dial 17, whereby the information regarding time, date, and day displayed on the second display device 9 can be visually recognized.

In this embodiment, the upper housing 13 is formed such that the 12 o'clock side is one step higher and the 6 o'clock side is one step lower with the step section L, which is on the straight line connecting the 3 o'clock side and the 9 o'clock side at the point slightly closer to the 12 o'clock side than the central portion, as a boundary. Accordingly, the dial 17 arranged on the upper housing 13 is formed such that the 12 o'clock side is one step higher and the 6 o'clock side is one step lower with the step section L on the straight line connecting the 3 o'clock side and the 9 o'clock side as a boundary.

As a result of this structure, information regarding an elapsed time such as a second time or a minute time displayed on the first display device 8 and information regarding time, date, and day displayed on the second display device 9 can be viewed with a height difference. Accordingly, the information displayed on the first display device 8 and the second display device 9, together with the dial 17, is stereoscopically represented, whereby the design is improved.

Also, the function hand 11 attached to the function hand shaft 12 of the function hand driving mechanism section 10 is driven by the function hand driving mechanism section 10, and moves above the portion of the dial 17 formed one step lower so as to swing around the function hand shaft 12 in the transverse direction, whereby the various types of modes such as the timer mode, the stopwatch mode, and the azimuth mode (retrograde mode) are selectively indicated.

In this embodiment, the function hand 11 moves above the first display device 8 arranged in parallel with the hand driving mechanism section 6 in a planar view while being positioned below the hands 5 of the hand driving mechanism section 6, and therefore does not come in contact with the hands 5. The movement area of the function hand 11 is widely provided above the first display device 8, and the function hand 11 moves in this wide area.

Also, the function hand 11 moves while being positioned substantially in parallel with the second display device 9 arranged one step higher than the first display device 8 arranged in parallel with the hand driving mechanism section 6, so that information regarding time, date, and day displayed on the second display device 9 is not blocked by the function hand 11. This function hand 11 is provided between the hands 5 and the first display device 8, and moves having a height difference without coming in contact with the hands 5.

Accordingly, by using synthetic resin or metal, the function hand 11 is formed having a thick shape and a large size, as with the hands 5. As a result, the function hand 11 can be easily viewed, and a mode indicated by the function hand 11 from among the various types of modes such as the timer mode, the stopwatch mode, and the azimuth mode can be easily viewed.

That is, this function hand 11 is structured to include the hand body 21 having a substantially band shape and the sidewall section 22 provided on the outer peripheral portion of the hand body 21 as in the case of the hands 5, and therefore can be formed to be thick and large. As a result, the function hand 11 can be easily viewed and has a strong presence.

In this case as well, in the function hand 11, the wide other end 21*b* of the hand body 21 is formed in a shape having a decoration, and the outer surface of the sidewall section 22, together with the hand body 21, is decorated with a color, a mark, etc. (not shown). As a result, the decoration and the design of the function hand 11 are improved, whereby the function hand 11 has a stronger presence, as in the case of the hands 5.

As described above, the timepiece module 4 in this wristwatch includes the hand driving mechanism section 6 which drives the hand shaft 7 to which the hands 5 are attached and moves the hands 5, and the first display device 8 which is arranged in parallel with this hand driving mechanism section 6 and displays information. Accordingly, the length of the hand shaft 7 can be shortened. As a result, the design of the function hand 11 is improved, whereby the function hand 11 has a strong presence.

That is, in the timepiece module 4 in this wristwatch, the hand shaft 7 can protrude by a sufficient length above the first display device 8 arranged in parallel with the hand driving mechanism section 6 in a planar view although the length of the hand shaft 7 of the hand driving mechanism section 6 which moves the hands 5 is a limited length. Accordingly, the hands 5 can be formed having a free shape without being restricted by the thickness. As a result, the design of the hands 5 can be improved, so that the hands 5 have a strong presence.

In this embodiment, the hand driving mechanism section 6 and the first display device 8 are arranged in parallel with the intermediate housing 14 arranged below the upper housing 13, in a planar view. Accordingly, although the length of the hand shaft 7 of the hand driving mechanism section 6 is a limited length, the hand shaft 7 can reliably and favorably protrude by a sufficient length above the upper surface of the intermediate housing 14 where the first display device 8 is arranged. As a result, the hands 5 can be favorably moved above the first display device 8.

Also, in this hand driving mechanism section 6, the hands 5 can reliably and favorably indicate hour marks 17*a* provided on the outer peripheral portions of the dial 17 by the hand shaft 7 being driven to move the hands 5 above the dial 17 arranged on the upper housing 13. Accordingly, the current time can be accurately and favorably known, and a timepiece having a stereoscopic effect can be achieved by the dial 17 and the first display device 8.

Also, on the first display device, information regarding an elapsed time such as a second time or a minute time is displayed 8 by use of a chronograph. This displayed information can be viewed from above via the first housing display window section 24 in the upper housing 13 and the first dial display window section 25 in the dial 17. Accordingly, this information regarding an elapsed time such as a second time or a minute time displayed on the first display device 8 by using a chronograph can be unfailingly and favorably viewed.

In this embodiment, the first housing display window section 24 in the upper housing 13 is formed in a rectangular shape having substantially the same size as that of the shape of the first display device 8, and the first dial display window section 25 in the dial 17 is formed in the same circular arc shape as that of the display area of the first display device 8. As a result, by the first housing display window section 24 and the first dial display window section 25, the design of the display area of the first display device 8 is improved.

Also, in this timepiece module 4, information regarding an elapsed time such as a second time or a minute time on the first display device 8 can be displayed with depth by the first housing display window section 24 and the first dial display window section 25. By this sense of depth, information on the first display device 8 can be displayed stereoscopically, which improves the design.

Also, in the timepiece module 4 in this wristwatch, each hand 5 is thick, which improves the viewability and the design of the hands 5. That is, by using synthetic resin or metal, the hands 5 are formed having a thick shape and a large size, so that the hands 5 can be easily viewed, and the time indicated thereby can be unfailingly and reliably viewed.

In this embodiment, each hand 5 is structured to include the hand body 21 in a substantially band shape and the sidewall section 22 provided on the outer peripheral portion of this hand body 21. Accordingly, the hands 5 can be formed having a thick shape and a large size. As a result, the hands 5 can be more easily viewed and have a strong presence.

Also, in each hand 5, the decorative section 21*d* can be provided in the other end 21*b* of the hand body 21 having a substantially fan shape, and the outer surface of the sidewall section 22, together with the hand body 21, can be decorated with a color, a mark, etc. (not shown). Accordingly, the decoration and the design of the hands 5 can be improved, whereby the hands 5 can have a stronger presence.

Also, this timepiece module 4 includes the second display device 9 arranged in a manner not to overlap with the first display device 8 at the position one step higher than the first display device 8 arranged in parallel with the hand driving mechanism section 6 in a planar view. As a result, different information can be stereoscopically and favorably displayed by the first display device 8 and the second display device 9.

That is, by the second display device 9 being arranged one step higher than the first display device 8 in a manner not to overlap with the first display device 8, information regarding an elapsed time such as a second time or a minute time displayed on the first display device 8 and information regarding time, date, and day displayed on the second display device 9 can be displayed with a height difference. As a result, the different information respectively displayed on the first display device 8 and the second display device 9 can be stereoscopically represented. By this structure as well, the design can be improved.

In this embodiment, the hand shaft 7 of the hand driving mechanism section 6 can reliably protrude above the second display device 9 by protruding by a sufficient length above the first display device 8 arranged in parallel with the hand driving mechanism section 6 in a planar view. As a result of this structure, the hands 5 can be formed to be thick, and the hands 5 attached to the hand shaft 7 can be favorably moved above the second display device 9.

Also, this timepiece module 4 includes the function hand 11 which moves above the first display device 8 arranged in parallel with the hand driving mechanism section 6 in a planar view, while being positioned below the hands 5 of the hand driving mechanism section 6. As a result of this structure, the function hand 11 does not come in contact with the hands 5, and therefore can favorably move above the first display device 8 and reliably select and favorably indicate one of the various types of modes such as the timer mode, the stopwatch mode, and the azimuth mode (retrograde mode).

In this embodiment, the function hand 11 moves while being positioned substantially in parallel with the second display device 9 arranged one step higher than the first display device 8 arranged in parallel with the hand driving mechanism section 6. That is, the function hand 11 can be favorably moved above the first display device 8 arranged one step lower than the second display device 9, without blocking information regarding time, date, and day displayed on the second display device 9.

As a result of this structure, in the timepiece module 4, the movement area of the function hand 11 can be widely provided above the first display device 8. Accordingly, the function hand 11 can be favorably moved in a wide range. In addition, as a result of the structure where the function hand 11 is moved while being positioned substantially in parallel with the second display device 9, the function hand 11 can be reliably and favorably mounted between the hands 5 and the first display device 8. Accordingly, the hands 5 and the function hand 11 can be made to have a difference in height, which improves the design and downsizes the entire timepiece module 4.

Also, in this timepiece module 4, the function hand driving mechanism section 10, which drives the function hand shaft 12 to which the function hand 11 is attached so as to move the function hand 11, is arranged below the first display device 8 arranged in parallel with the hand driving mechanism section 6 in a planar view. As a result, the function hand driving mechanism section 10 can be favorably mounted without being restricted by the mounting position of the first display device 8, and the function hand shaft 12 can reliably and favorably protrude above the first display device 8 via a side portion of the first display device 8.

In this embodiment, the function hand shaft 12 is formed to have, although its axial length is limited, the maximum axial length within the limitations of its production. As a result, the function hand shaft 12 can upwardly protrude by a sufficient length from the upper surface of the portion of the dial 17 formed one step lower. Accordingly, the function hand 11 can be formed to be thick, whereby its viewability and design can be improved.

That is, by using synthetic resin or metal, the function hand 11 can be formed having a thick shape and a large size, as with the hands 5. As a result, the function hand 11 can be easily viewed, and thereby can have a strong presence. In addition, a mode indicated by the function hand 11 can be unfailingly and favorably viewed.

In this embodiment, the function hand 11 is structured to include the hand body 21 having a substantially band shape and the sidewall section 22 provided on the outer peripheral portion of the hand body 21 as in the case of the hands 5, and therefore can be formed to be thick and large. As a result, the function hand 11 can be easily viewed and have a strong presence.

Also, in this function hand 11, the wide other end 21*b* of the hand body 21 can be formed in a decorative shape, and the outer surface of the sidewall section 22, together with the hand body 21, can be decorated with a color, a mark, etc. (not shown). As a result, the decoration and the design of the function hand 11 can be improved, whereby the function hand 11 can have a stronger presence.

Also, this timepiece module 4 includes the button-type battery 29 which is arranged in parallel with the function hand driving mechanism section 10 in a planar view. Accordingly, the mounting space of the battery 29 can be provided in a wide area excluding the mounting space of the function hand driving mechanism section 10. As a result, the battery 29 can be made larger in size and capacity while downsizing the entire timepiece module 4.

In the above-described embodiment, the structure has been described in which the function hand 11 of the function hand driving mechanism section 10 selectively indicates the various types of modes such as the timer mode, the stopwatch mode, and the azimuth mode. However, the present invention is not limited thereto. For example, the function hand 11 may be structured to selectively indicate other functions such as those for indicating the ebb and flow of the tide, the waxing and waning of the moon, etc.

Also, in the above-described embodiment, the structure has been described in which the first display device 8 displays information regarding an elapsed time such as a second time or a minute time by using a chronograph. However, the present invention is not limited thereto and, for example, information regarding temperature, humidity, air pressure, or water pressure may be displayed using a chronograph or numeric characters.

Moreover, in the above-described embodiment, the structure has been described in which the first display device 8 displays information regarding an elapsed time such as a second time or a minute time and the second display device 9 displays information regarding time, date, and day. However, the present invention is not limited thereto. The first display device 8 may be structured to display information regarding on time, date, and day, and the second display device 9 may be structured to display information regarding an elapsed time such as a second time or a minute time.

Furthermore, in the above-described embodiment, the present invention has been applied in a wristwatch. However, the present invention is not necessarily required to be applied in a wristwatch, and is applicable to various types of timepieces such as a travel watch, an alarm clock, a table clock, and a wall clock. Also, the present invention is not necessarily required to be applied in a timepiece, and is widely applicable to electronic devices such as a mobile phone and a personal digital assistant.

While the present invention has been described with reference to the preferred embodiments, it is intended that the invention be not limited by any of the details of the description therein but includes all the embodiments which fall within the scope of the appended claims.

What is claimed is:

1. A module comprising:

hands and a hand shaft to which the hands are attached, wherein the hand shaft extends along a hand shaft length direction;

a hand driving mechanism configured to drive the hand shaft so as to move the hands;

a first display screen configured to display information, wherein the first display screen and the hand driving mechanism are arranged to intersect a first plane perpendicular to the hand shaft length direction;

a second display screen configured to display information, wherein the second display screen is arranged between the first display screen and the hands along the hand shaft length direction, wherein the second display screen does not overlap with the first display screen in the hand shaft length direction;

a function hand and a function hand shaft to which the function hand is attached, wherein the function hand shaft extends along the hand shaft length direction;

a function hand driving mechanism configured to drive the function hand shaft so as to move the function hand; and a button-type battery, wherein the function hand driving mechanism and the button-type battery are arranged to intersect a second plane, parallel to the first plane, perpendicular to the hand shaft length direction.

2. The module according to claim 1, wherein the function hand is arranged between the first display screen and the hands in the hand shaft length direction.

3. The module according to claim 2, wherein the function hand and the second display screen are arranged to intersect a third plane perpendicular to the hand shaft length direction.

4. A timepiece comprising the module according to claim 3.

5. The module according to claim 3, wherein the first display screen is arranged between the function hand and the function hand driving mechanism in the hand shaft length direction.

6. The module according to claim 5, wherein the hand driving mechanism is arranged between the hands and the button-type battery in the hand shaft length direction.

7. The module according to claim 2, wherein the first display screen is arranged between the function hand and the function hand driving mechanism in the hand shaft length direction.

8. A timepiece comprising the module according to claim 7.

9. The module according to claim 7, wherein the hand driving mechanism is arranged between the hands and the button-type battery in the hand shaft length direction.

10. A timepiece comprising the module according to claim 9.

11. A timepiece comprising the module according to claim 2.

12. A timepiece comprising the module according to claim 1.

13. The module according to claim 1, wherein the function hand is arranged between the hands and the hand driving mechanism along the hand shaft length direction, and wherein the first display screen and the hand driving mechanism are arranged between the function hand and the function hand driving mechanism along the hand shaft length direction.

* * * * *